US007293968B2

(12) United States Patent
Hwang et al.

(10) Patent No.: US 7,293,968 B2
(45) Date of Patent: Nov. 13, 2007

(54) CAPACITY-CHANGING UNIT OF ORBITING VANE COMPRESSOR

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 141 days.

(21) Appl. No.: 11/111,850

(22) Filed: Apr. 22, 2005

(65) Prior Publication Data

US 2006/0073051 A1 Apr. 6, 2006

(30) Foreign Application Priority Data

Oct. 6, 2004 (KR) ..... 10-2004-0079621

(51) Int. Cl.
*F04C 14/26* (2006.01)
*F04C 18/344* (2006.01)

(52) U.S. Cl. ..... 418/29; 418/60

(58) Field of Classification Search ..... 418/59, 418/60, 29, 180; 417/213, 310
See application file for complete search history.

(56) References Cited

U.S. PATENT DOCUMENTS

| | | | | |
|---|---|---|---|---|
| 4,726,739 | A * | 2/1988 | Saitou et al. | 417/286 |
| 4,929,159 | A * | 5/1990 | Hayase et al. | 417/295 |
| 5,051,070 | A * | 9/1991 | Kazaoka et al. | 417/295 |
| 5,284,426 | A * | 2/1994 | Strikis et al. | 418/6 |
| 5,399,076 | A * | 3/1995 | Matsuda et al. | 418/6 |
| 6,045,337 | A * | 4/2000 | Tokumasu | 417/213 |
| 6,079,955 | A * | 6/2000 | Miyazawa et al. | 417/213 |
| 6,478,550 | B2 * | 11/2002 | Matsuba et al. | 417/310 |
| 6,663,358 | B2 * | 12/2003 | Loprete et al. | 417/313 |
| 6,932,588 | B2 * | 8/2005 | Choi et al. | 418/63 |
| 6,962,485 | B2 * | 11/2005 | Bennett et al. | 417/213 |
| 2003/0059312 | A1 * | 3/2003 | Konishi et al. | 417/213 |
| 2003/0063982 | A1 * | 4/2003 | Pham | 417/292 |

FOREIGN PATENT DOCUMENTS

| | | | |
|---|---|---|---|
| JP | 55-119994 | | 9/1980 |
| KR | 10-2004-0007984 | | 1/2001 |
| KR | 1020040007984 | * | 1/2004 |

OTHER PUBLICATIONS

U.S. Appl. No. 11/111,844.
U.S. Appl. No. 11/111,849.
U.S. Appl. No. 11/111,861.
U.S. Appl. No. 11/111,862.
U.S. Appl. No. 11/111,863.
U.S. Appl. No. 11/111,881.

* cited by examiner

*Primary Examiner*—Thomas Denion
*Assistant Examiner*—Mary A Davis
(74) *Attorney, Agent, or Firm*—Greenblum & Bernstein, P.L.C.

(57) ABSTRACT

Disclosed herein is a capacity-changing unit disposed in an orbiting vane compressor, which compresses refrigerant gas introduced into a cylinder through an orbiting movement of an orbiting vane in the cylinder, for easily changing capacity of the orbiting vane compressor in a mechanical bypass fashion. The capacity-changing unit comprises a bypass channel communicating with an outer compression chamber formed in the cylinder, and a bypass valve disposed on the bypass channel for opening and closing the bypass channel. According to the present invention, the orbiting vane compressor is selectively operated not only in normal operation mode where compression is performed in an inner compression chamber as well as the outer compression chamber but also in economic operation mode where compression is performed only in the inner compression chamber.

2 Claims, 7 Drawing Sheets

CAPACITY-CHANGING UNIT OF ORBITING VANE COMPRESSOR

BACKGROUND OF THE INVENTION

1. Field of the Invention

The present invention relates to an orbiting vane compressor, and, more particularly, to a capacity-changing unit disposed in an orbiting vane compressor, which compresses refrigerant gas introduced into a cylinder through an orbiting movement of an orbiting vane in the cylinder, for easily changing capacity of the orbiting vane compressor in a mechanical bypass fashion without interrupting the operation of the orbiting vane compressor.

2. Description of the Related Art

Generally, an orbiting vane compressor has inner and outer compression chambers formed in a cylinder through an orbiting movement of an orbiting vane in the cylinder. FIG. 1 is a longitudinal sectional view illustrating the overall structure of a conventional orbiting vane compressor. The conventional orbiting vane compressor shown in FIG. 1 is a hermetically sealed type low-pressure orbiting vane compressor that can be applied to a refrigerator or an air conditioner as a hermetically sealed type refrigerant compressor, which has been proposed by the applicant of the present application.

As shown in FIG. 1, a drive unit D and a compression unit P are mounted in a shell 1 while the drive unit D and the compression unit P are hermetically sealed. The drive unit D and the compression unit P are connected to each other via a vertical crankshaft 8, the upper and lower ends of which are rotatably supported by a main frame 6 and a subsidiary frame 7, such that power from the drive unit D is transmitted to the compression unit P through the crankshaft 8.

The drive unit D comprises: a stator 2 fixedly disposed between the main frame 6 and the subsidiary frame 7; and a rotor 3 disposed in the stator 2 for rotating the crankshaft 8, which vertically extends through the rotor 3, when electric current is supplied to the rotor 3. The rotor 3 is provided at the top and bottom parts thereof with balance weights 3*a*, which are disposed symmetrically to each other for preventing the crankshaft 8 from being rotated in an unbalanced state due to a crank pin 81.

The compression unit P comprises an orbiting vane 5 having a boss 55 formed at the lower part thereof. The crank pin 81 is fixedly fitted in the boss 55 of the orbiting vane 5. As the orbiting vane 5 performs an orbiting movement in a cylinder 4, refrigerant gas introduced into the cylinder 4 is compressed. The cylinder 4 comprises an inner ring 41 integrally formed at the upper part thereof while being protruded downward. The orbiting vane 5 comprises a circular vane 51 formed at the upper part thereof while being protruded upward. The circular vane 51 performs an orbiting movement in an annular space 42 defined between the inner ring 41 and the inner wall of the cylinder 4. Through the orbiting movement of the circular vane 51, inner and outer compression chambers are formed at the inside and the outside of the circular vane 51, respectively. Refrigerant gases compressed in the inner and outer compression chambers are discharged out of the cylinder 4 through inner and outer outlet ports 44 and 44*a* formed at the upper part of the cylinder 4, respectively.

Between the main frame 6 and the orbiting vane 5 is disposed an Oldham's ring 9 for preventing rotation of the orbiting vane 5. Through the crankshaft 8 is longitudinally formed an oil supplying channel 82 for allowing oil to be supplied to the compression unit P therethrough when an oil pump 83 mounted at the lower end of the crankshaft 8 is operated.

Unexplained reference numeral 11 indicates an inlet tube, 12 a high-pressure chamber, and 13 an outlet tube.

When electric current is supplied to the drive unit D, the rotor 3 of the drive unit D is rotated, and therefore, the crankshaft 8 is also rotated. As the crankshaft 8 is rotated, the orbiting vane 5 of the compression unit P performs an orbiting movement along a radius of the orbiting movement while the crank pin 81 of the crankshaft 8 is eccentrically fitted in the boss 55 formed at the lower part of the orbiting vane 5.

As a result, the circular vane 51 of the orbiting vane 5, which is inserted in the annular space 42 defined between the inner ring 41 and the inner wall of the cylinder 4, also performs an orbiting movement to compress refrigerant gas introduced into the annular space 42. At this time, the inner and outer compression chambers are formed at the inside and the outside of the circular vane 51 in the annular space 41, respectively. Refrigerant gases compressed in the inner and outer compression chambers are guided to the high-pressure chamber 12, which is disposed above the cylinder 4, through the inner and outer outlet ports 44 and 44*a* of the cylinder 4, which communicate with the inner and outer compression chambers, respectively, and are then discharged out of the orbiting vane compressor through the outlet tube 13. In this way, high-temperature and high-pressure refrigerant gas is discharged.

FIG. 2 is an exploded perspective view illustrating the structure of the compression unit P shown in FIG. 1.

In the compression unit P of the orbiting vane compressor, as shown in FIG. 2, the orbiting vane 5, which is connected to the crankshaft 8, is disposed on the upper end of the main frame 6, which rotatably supports the upper part of the crankshaft 8. The cylinder 4, which is attached to the main frame 6, is disposed above the orbiting vane 5. The cylinder 4 is provided at a predetermined position of the circumferential part thereof with an inlet port 43. The inner and outer outlet ports 44 and 44*a* are formed at predetermined positions of the upper end of the cylinder 4.

At a predetermined position of the circumferential part of the circular vane 51 of the orbiting vane 5 is formed a through-hole 52 for allowing refrigerant gas introduced through the inlet port 43 of the cylinder 4 to be guided into the circular vane 51 therethrough. The through-hole 52 is opened to the upper part of the circular vane 51 and to a slider 54. The slider 54 is disposed in an opening 53, which is formed at another predetermined position of the circumferential part of the circular vane 51 of the orbiting vane 5 while being adjacent to the position where the through-hole 52 is formed, for maintaining the seal between the inner and outer compression chambers of the circular vane 51.

FIG. 3 is a cross-sectional view illustrating the compression operation of the conventional orbiting vane compressor shown in FIG. 1.

When the orbiting vane 5 of the compression unit P is driven by power transmitted to the compression unit P from the drive unit D through the crankshaft 8 (See FIG. 1), the circular vane 51 of the orbiting vane 5 disposed in the annular space 42 of the cylinder 4 performs an orbiting movement in the annular space 42 defined between the inner wall of the cylinder 4 and the inner ring 41, as indicated by arrows, to compress refrigerant gas introduced into the annular space 42 through the inlet port 43.

At the initial orbiting position of the orbiting vane 5 of the compression unit P (i.e., the 0-degree orbiting position), refrigerant gas is introduced into an inner suction chamber A1 as the inner suction chamber Al communicates with the inlet port 43, and compression is performed in an outer compression chamber B2 of-the circular vane 51 while the outer compression chamber B2 does not communicate with the inlet port 43 and the outer outlet port 44*a*. Refrigerant gas is compressed in an inner compression chamber A2, and at the same time, the compressed refrigerant gas is discharged out of the inner compression chamber A2 through the inner outlet port 44.

At the 90-degree orbiting position of the orbiting vane 5 of the compression unit P, the compression is still performed in the outer compression chamber B2 of the circular vane 51, and almost all the compressed refrigerant gas is discharged out of the inner compression chamber A2 through the inner outlet port 44. At this stage, an outer suction chamber B1 appears so that refrigerant gas is introduced into the outer suction chamber B1 through the inlet port 43.

At the 180-degree orbiting position of the orbiting vane 5 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the orbiting vane 5 of the compression unit P, almost all the compressed refrigerant gas is discharged out of the outer compression chamber B2 of the circular vane 51 through the outer outlet port 44*a*, and the compression is still performed in the inner compression chamber A2 of the circular vane 51. Also, compression is newly performed in the outer suction chamber B1. When the orbiting vane 5 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the orbiting vane 5 of the compression unit P is returned to the position where the orbiting movement of the orbiting vane 5 is initiated. In this way, a 360-degree-per-cycle orbiting movement of the orbiting vane 5 of the compression unit P is accomplished. The orbiting movement of the orbiting vane 5 of the compression unit P is repeatedly performed in succession.

Meanwhile, a refrigerating apparatus, such as a refrigerator, or an air-conditioning apparatus, such as an air-conditioner, is operated in economic operation mode where the operation of the compressor is interrupted when the interior temperature of the refrigerator or the room temperature is decreased to reach a predetermined level, and the operation of the compressor is resumed when the interior temperature of the refrigerator or the room temperature is increased above the predetermined level. In the economic operation mode, the operation of the compressor is alternately interrupted and resumed. Generally, much more electric power is consumed when the compressor is initiated or resumed after being interrupted than when the compressor is operated in a normal state. When the operation of the compressor is abruptly interrupted and then resumed, components of the compressor may wear out quickly due to interference between load of compressed air in the compressor and the components of the compressor, and therefore, the service life of the compressor may be shortened.

Consequently, it is necessary to change the capacity of the compressor without alternately interrupting and resuming the operation of the compressor. The capacity of the compressor may be changed in an inverter system, i.e., by controlling the number of rotations of the drive unit of the compressor, such as a motor. However, this inverter system requires various electric circuit control devices and relevant parts, which are very expensive. As a result, the manufacturing costs of the compressor are increased, and therefore, the price competitiveness of the compressor is lowered.

SUMMARY OF THE INVENTION

Therefore, the present invention has been made in view of the above problems, and it is an object of the present invention to easily change capacity of an orbiting vane compressor that compresses refrigerant gas introduced into a cylinder through an orbiting movement of an orbiting vane in the cylinder in a mechanical bypass fashion without interrupting the operation of the orbiting vane compressor.

It is another object of the present invention to provide a capacity-changing unit that can be applied to a low-pressure type orbiting vane compressor for easily changing capacity of the low-pressure type orbiting vane compressor in a mechanical bypass fashion without interrupting the operation of the orbiting vane compressor.

It is another object of the present invention to provide a capacity-changing unit that can be applied to a high-pressure type orbiting vane compressor for easily changing capacity of the high-pressure type orbiting vane compressor in a mechanical bypass fashion without interrupting the operation of the orbiting vane compressor.

It is yet another object of the present invention to provide a capacity-changing unit that can be selectively applied to low-pressure type and high-pressure type orbiting vane compressors for easily changing capacities of the low-pressure type and high-pressure type orbiting vane compressors in a mechanical bypass fashion without interrupting the operation of the respective orbiting vane compressors.

In accordance with the present invention, the above and other objects can be accomplished by the provision of a capacity-changing unit of an orbiting vane compressor, comprising: inner and outer compression chambers formed in an annular space defined in a cylinder for compressing refrigerant gas, the inner and outer compression chambers being isolated from each other by a circular vane of an orbiting vane, which is disposed in the annular space; a bypass channel formed in the cylinder such that the bypass channel communicates with the outer compression chamber; and a bypass valve disposed on the bypass channel.

Preferably, the annular space is defined between the inner wall of the cylinder and an inner ring disposed in the cylinder.

Preferably, the cylinder is provided at the upper part thereof with a pair of inner and outer outlet ports, which communicate with the inner and outer compression chambers, respectively.

Preferably, the circular vane is provided at a predetermined position of the circumferential part thereof with an opening, and the orbiting vane further comprises: a slider disposed in the opening.

Preferably, the circular vane is provided at another predetermined position of the circumferential part thereof, adjacent to the position where the slider is disposed, with a through-hole for allowing refrigerant gas to be introduced into the circular vane therethrough.

Preferably, the cylinder is provided at a predetermined position of the circumferential part thereof with an inlet port, which communicates with the through-hole of the circular vane.

Preferably, the bypass channel comprises a communication port formed on the cylinder between a 90-degree orbiting position of the circular vane and a 360-degree orbiting position of the circular vane where compression is performed when the circular vane repeatedly performs a 360-degree-per-cycle orbiting movement in the cylinder, the communication port communicating with the outside of the cylinder.

Preferably, the bypass channel comprises an inner passage formed on the cylinder between a 90-degree orbiting position of the circular vane and a 360-degree orbiting position of the circular vane where compression is performed when the circular vane repeatedly performs a 360-degree-per-cycle orbiting movement in the cylinder, the inner passage communicating with the inlet port of the cylinder while not communicating with the outside of the cylinder.

Preferably, the bypass channel comprises an outer passage formed on the cylinder between a 90-degree orbiting position of the circular vane and a 360-degree orbiting position of the circular vane where compression is performed when the circular vane repeatedly performs a 360-degree-per-cycle orbiting movement in the cylinder, the outer passage communicating with the inlet port of the cylinder while not communicating with the outside of the cylinder.

Preferably, the bypass valve disposed on the bypass channel comprises a solenoid for directly opening and closing the bypass channel when electric current is supplied to the solenoid.

Preferably, the bypass channel comprises: a communication line communicating with the outer compression chamber of the cylinder; a bypass line disposed between the communication line and the inlet port of the cylinder; a piston, having one end connected to the bypass line and the other end connected to a pressurizing line communicating with the inner and outer outlet ports of the cylinder, for interrupting communication between the communication line and the bypass line when pressure is applied to the piston through the pressurizing line; and a solenoid for moving the piston in the direction opposite to the direction where communication between the communication line and the bypass line is interrupted when electric current is supplied to the solenoid.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 4A:
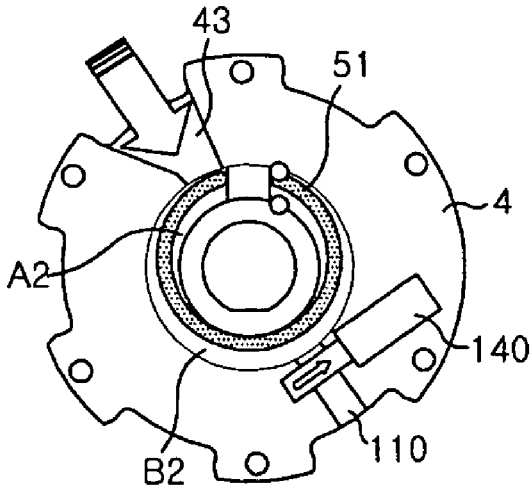
FIGS. 4A and 4B are cross-sectional views respectively illustrating the operation of a capacity-changing unit of an orbiting vane compressor according to a first preferred embodiment of the present invention.
Figure 4B:
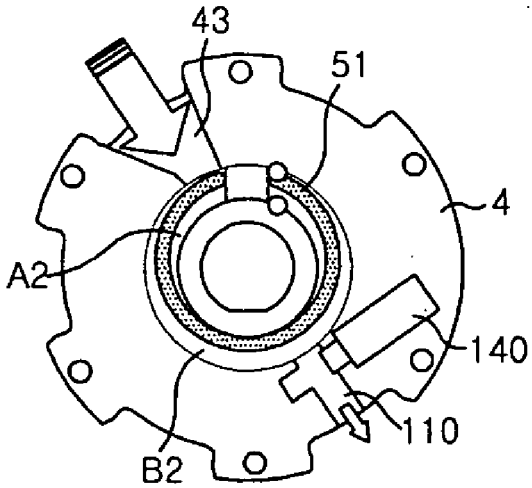

FIGS. 4A and 4B are cross-sectional views respectively illustrating the operation of a capacity-changing unit of an orbiting vane compressor according to a first preferred embodiment of the present invention.

A compression unit P of the orbiting vane compressor comprises an orbiting vane 5 connected to a crankshaft 8. The orbiting vane 5 is disposed on the upper end of a main frame 6, which rotatably supports the upper part of the crankshaft 8. A cylinder 4, which is attached to the main frame 6, is disposed above the orbiting vane 5. The cylinder 4 is provided at a predetermined position of the circumferential part thereof with an inlet port 43. Inner and outer outlet ports 44 and 44*a* are formed at predetermined positions of the upper end of the cylinder 4.

Figure 1:
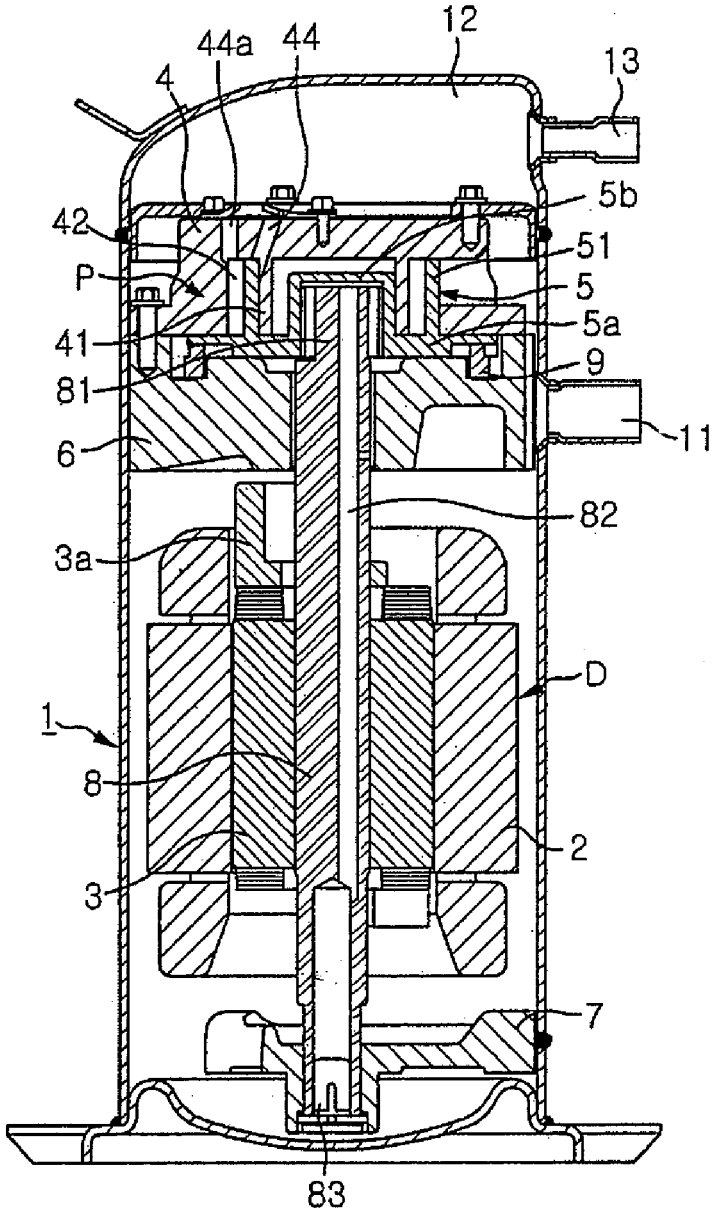
Related Art FIG. 1
FIG. 1 is a longitudinal sectional view illustrating the overall structure of a conventional orbiting vane compressor.
Figure 2:
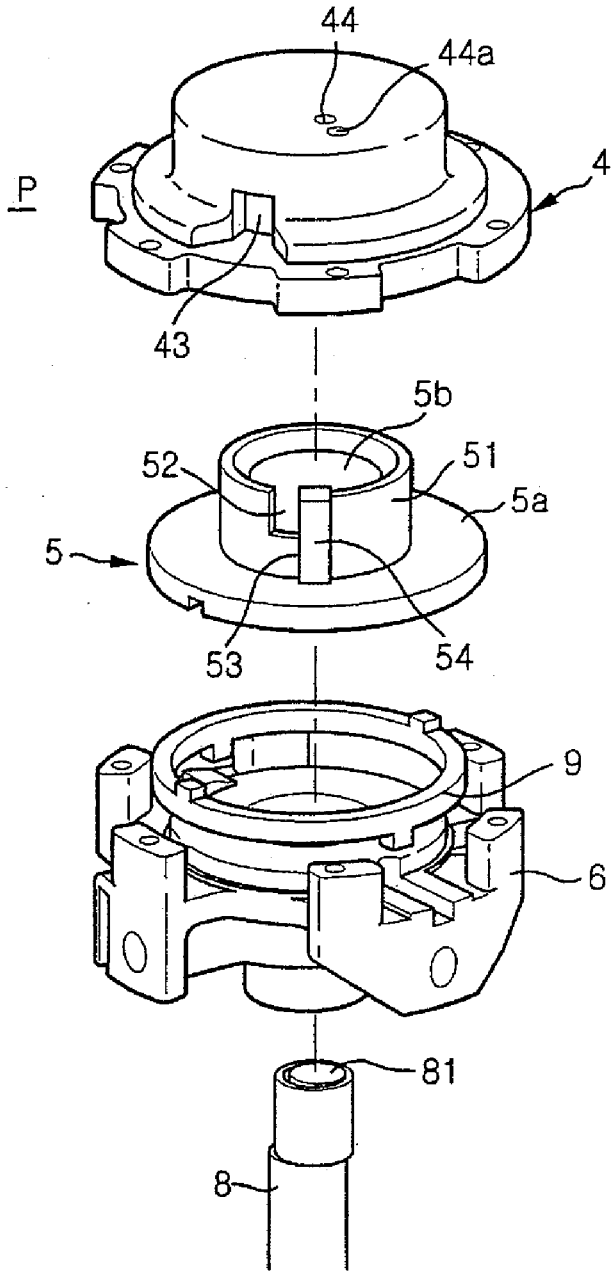
Related Art FIG.2
FIG. 2 is an exploded perspective view illustrating the structure of a compression unit of the conventional orbiting vane compressor shown in FIG. 1.
Figure 3:
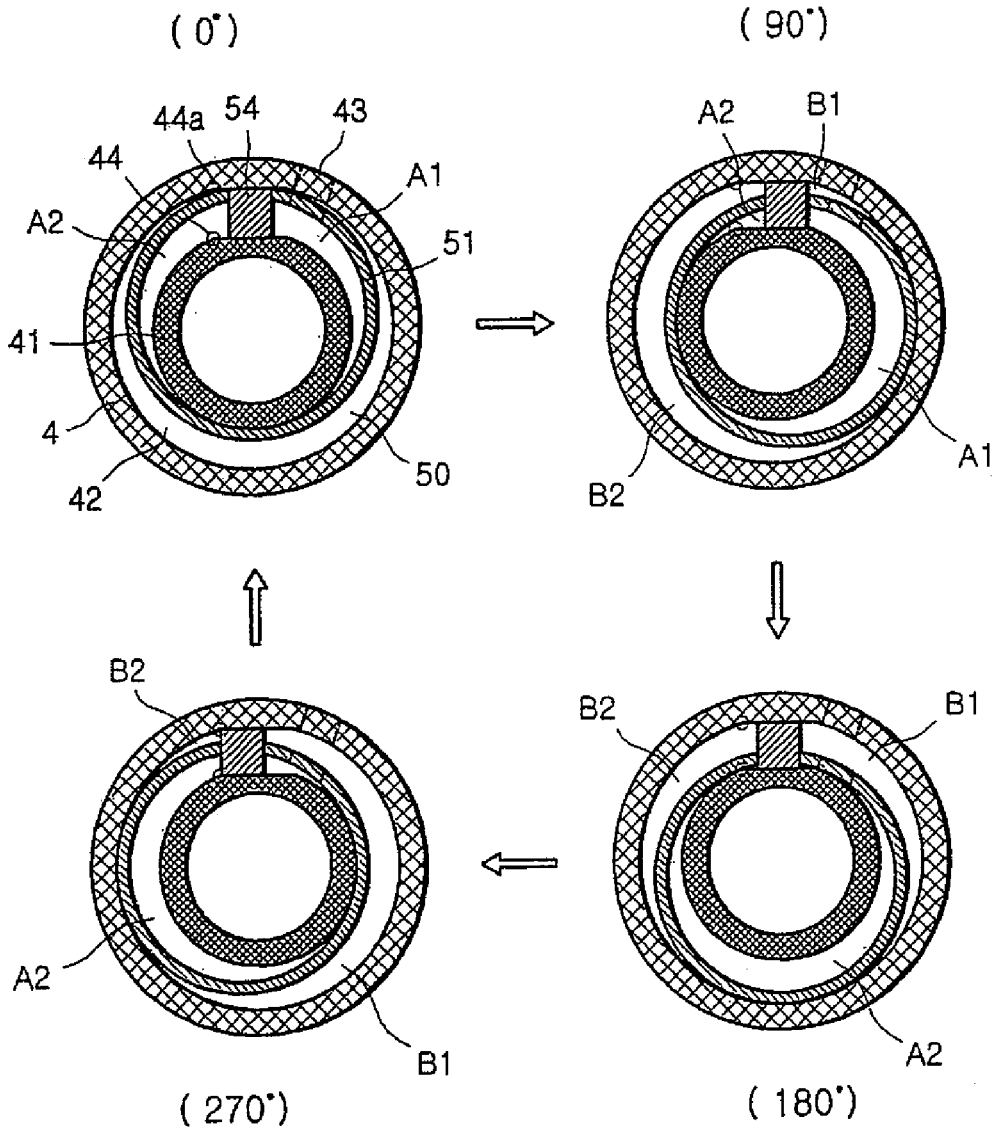
Related Art FIG.3
FIG. 3 is a cross-sectional view illustrating the compression operation of the conventional orbiting vane compressor shown in FIG. 1.

At a predetermined position of the circumferential part of a circular vane 51, which is provided at the upper part of the orbiting vane 5, is formed a through-hole 52 for allowing refrigerant gas introduced through the inlet port 43 of the cylinder 4 to be guided into the circular vane 51 therethrough. The through-hole 52 is opened to the upper part of the circular vane 51 and to a slider 54. The slider 54 is disposed in an opening 53, which is formed at another predetermined position of the circumferential part of the circular vane 51 of the orbiting vane 5 while being adjacent to the position where the through-hole 52 is formed, for maintaining the seal between inner and outer compression chambers A2 and B2 of the circular vane 51, which will be described below in detail (See FIG. 2).

The orbiting vane compressor according to the illustrated first embodiment of the present invention is characterized by a bypass channel communicating with the outer compression chamber B2 formed in the cylinder 4. On the bypass channel is disposed a bypass valve for opening and closing the bypass channel.

The bypass channel and the bypass valve will be described in more detail with reference to the accompanying drawings. When the circular vane 51 repeatedly performs a 360-degree-per-cycle orbiting movement in an annular space 42 defined in the cylinder 4, compression is substantially performed in the inner and outer compression chambers A2 and B2 formed in the cylinder 4 between the 90-degree orbiting position of the circular vane 51 and the 360-degree orbiting position of the circular vane 51. On the cylinder 4 is formed a communication port 110, which communicates with the inlet port 43 of the cylinder and the outside of the cylinder 4, between the 90-degree orbiting position of the circular vane 51 and the 360-degree orbiting position of the circular vane 51, as shown in FIG. 4A. In this way, the bypass channel is constructed.

On the communication port 110 is disposed a solenoid 140, which is operated when electric current is supplied to the solenoid 140, as the bypass valve. The communication port 110 is directly opened and closed by the solenoid 140. The above-described construction is usually applied to a low-pressure type orbiting vane compressor.

When the orbiting vane compressor is operated in normal operation mode, as shown in FIG. 4A, the communication port 110 of the cylinder 4 is closed by the solenoid 140, and therefore, compression is performed not only in the inner compression chamber A2 but also in the outer compression chamber B2. When the orbiting vane compressor is operated in economic operation mode, as shown in FIG. 4B, the communication port 110 of the cylinder 4 is opened by the solenoid 140, and therefore, refrigerant gas introduced into the outer compression chamber B2 through the inlet port 43 of the cylinder 4 is discharged out of the cylinder 4 through the communication port 110. As a result, compression is performed only in the inner compression chamber A2 while compression is not performed in the outer compression chamber B2.

Figure 5A:
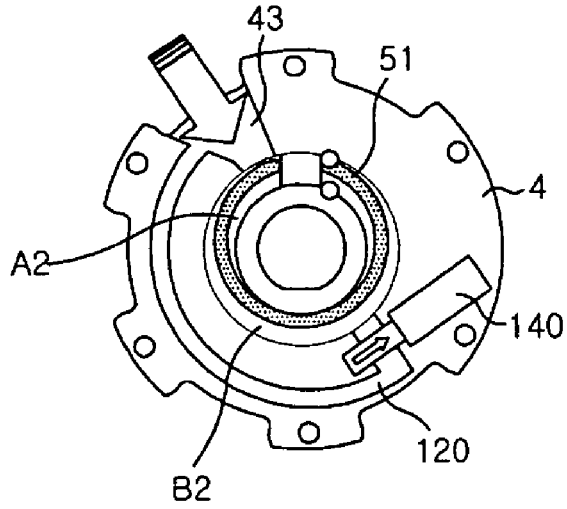
FIGS. 5A and 5B are cross-sectional views respectively illustrating the operation of a capacity-changing unit of an orbiting vane compressor according to a second preferred embodiment of the present invention.
Figure 5B:
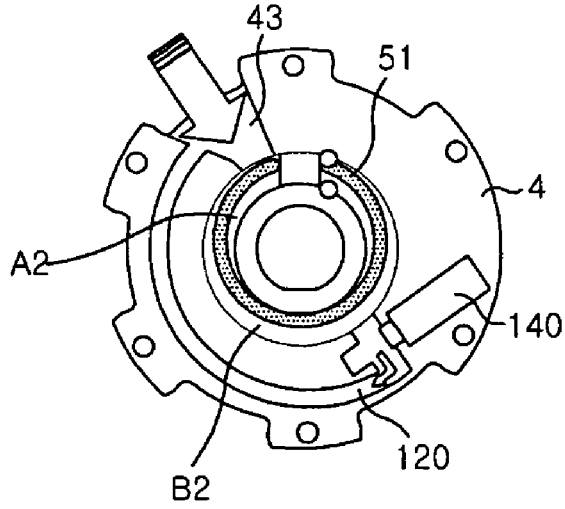

FIGS. 5A and 5B are cross-sectional views respectively illustrating the operation of a capacity-changing unit of an orbiting vane compressor according to a second preferred embodiment of the present invention.

When the circular vane 51 repeatedly performs a 360-degree-per-cycle orbiting movement in the annular space 42 of the cylinder 4, compression is substantially performed in the inner and outer compression chambers A2 and B2 formed in the cylinder 4 between the 90-degree orbiting position of the circular vane 51 and the 360-degree orbiting position of the circular vane 51. On the cylinder 4 is formed an inner passage 120, which communicates with the inlet port 43 of the cylinder 4, between the 90-degree orbiting position of the circular vane 51 and the 360-degree orbiting position of the circular vane 51, as shown in FIG. 4A. In this way, the bypass channel is constructed. On the inner passage 120 is disposed a solenoid 140 as the bypass valve. The inner passage 120 is directly opened and closed by the solenoid 140 when electric current is supplied to the solenoid 140. The above-described construction is usually applied to a high-pressure type orbiting vane compressor.

When the orbiting vane compressor is operated in normal operation mode, as shown in FIG. 5A, the inner passage 120 of the cylinder 4 is closed by the solenoid 140, and therefore, compression is performed not only in the inner compression chamber A2 but also in the outer compression chamber B2. When the orbiting vane compressor is operated in economic operation mode, as shown in FIG. 5B, the inner passage 120 of the cylinder 4 is opened by the solenoid 140, and therefore, refrigerant gas introduced into the outer compression chamber B2 through the inlet port 43 of the cylinder 4 is bypassed to the inlet port 43. As a result, compression is performed only in the inner compression chamber A2 while compression is not performed in the outer compression chamber B2 due to an idling phenomenon such as no-load operation.

Figure 6A:
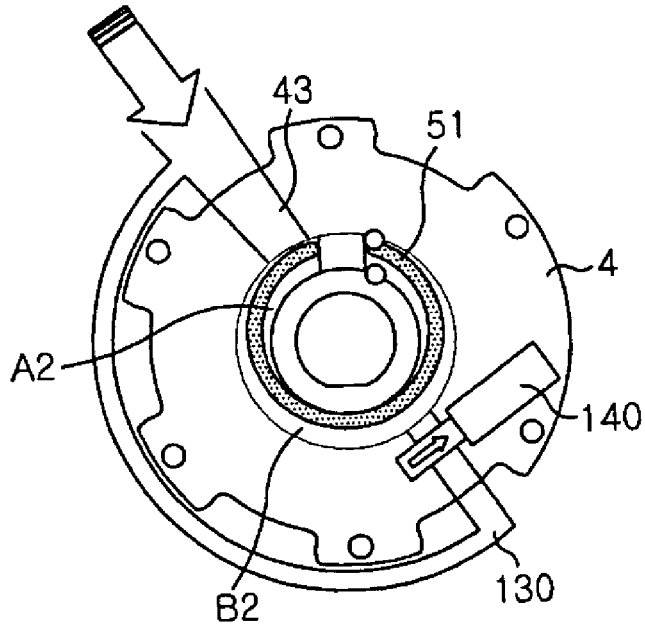
FIGS. 6A and 6B are cross-sectional views respectively illustrating the operation of a capacity-changing unit of an orbiting vane compressor according to a third preferred embodiment of the present invention.
Figure 6B:
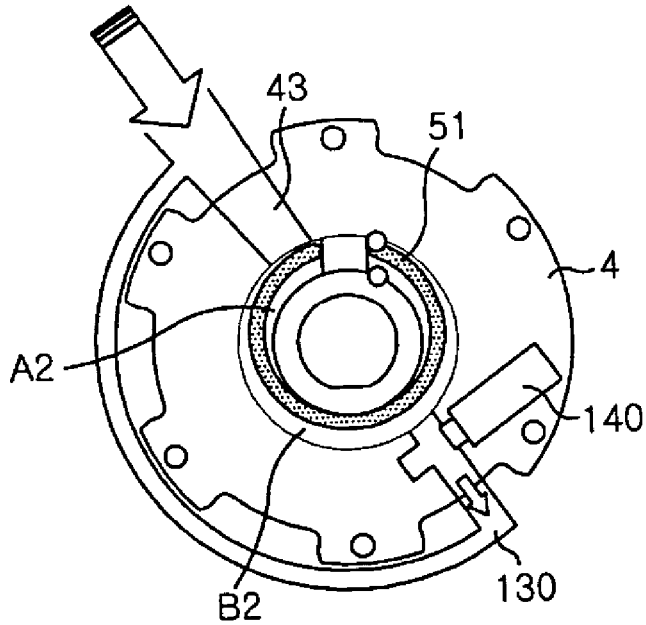

FIGS. 6A and 6B are cross-sectional views respectively illustrating the operation of a capacity-changing unit of an orbiting vane compressor according to a third preferred embodiment of the present invention.

The third preferred embodiment of the present invention is identical in construction and operation to the previously described second preferred embodiment of the present invention except that an outer passage 130 is formed instead of the inner passage 120. Accordingly, a detailed description of the third preferred embodiment of the present invention will not be given.

Figure 7A:
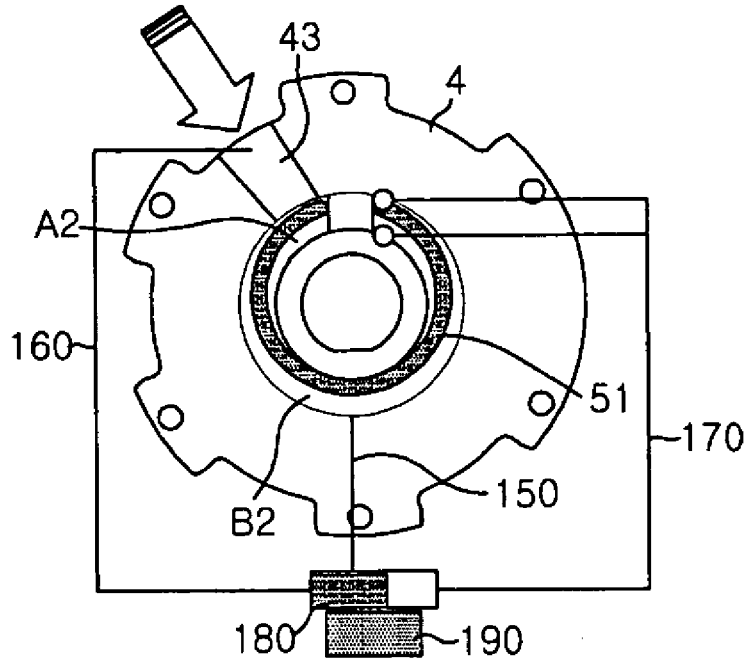
FIGS. 7A and 7B are cross-sectional views respectively illustrating the operation of a capacity-changing unit of an orbiting vane compressor according to a fourth preferred embodiment of the present invention.
Figure 7B:
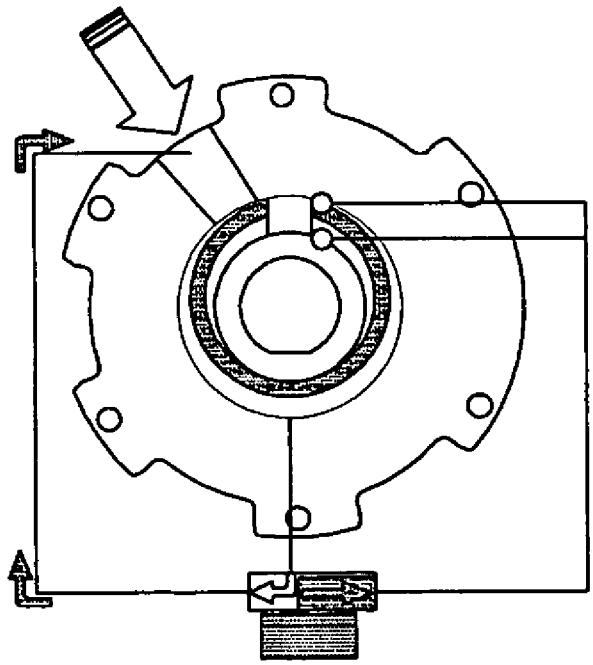

FIGS. 7A and 7B are cross-sectional views respectively illustrating the operation of a capacity-changing unit of an orbiting vane compressor according to a fourth preferred embodiment of the present invention.

As shown in FIGS. 7A and 7B, the bypass channel comprises: a communication line 150 communicating with the outer compression chamber B2 of the cylinder 4; and a bypass line 160 disposed between the communication line 150 and the inlet port 43 of the cylinder 4.

Between the communication line 150 and the bypass line 160 are disposed a piston 180 and a solenoid 190 as the bypass valve for opening and closing the bypass channel. One end of the piston 180 is connected to the bypass line 160, and the other end of the piston 180 is connected to a pressurizing line 170, which communicates with the inner and outer outlet ports 44 and 44*a* of the cylinder 4. Consequently, communication between the communication line 150 and the bypass line 160 is interrupted when the pressure is applied to the piston 180 through the pressurizing line 170.

When electric current is supplied to the solenoid 190, the piston 180 is moved, in the direction opposite to the direction where communication between the communication line 150 and the bypass line 160 is interrupted, by the solenoid 190 such that communication between the communication line 150 and the bypass line 160 is accomplished. The fourth preferred embodiment of the present invention with the above-stated construction can be compatibly applied not only to the low-pressure type orbiting vane compressor but also to the high-pressure type orbiting vane compressor.

When the orbiting vane compressor is operated in normal operation mode, as shown in FIG. 7A, the pressure of refrigerant gas discharged through the inner and outer outlet ports 44 and 44*a* of the cylinder 4 is applied to the piston 180 through the pressurizing line 170. Consequently, communication between the communication line 150 and the bypass line 160 is interrupted by the piston 180. As a result, compression is performed not only in the inner compression chamber A2 but also in the outer compression chamber B2.

When the orbiting vane compressor is operated in economic operation mode, as shown in FIG. 7B, electric current is supplied to the solenoid 190, and the piston 180 is moved, in the direction opposite to the direction where communication between the communication line 150 and the bypass line 160 is interrupted, by the solenoid 190 such that communication between the communication line 150 and the bypass line 160 is accomplished. As a result, refrigerant gas in the outer compression chamber B2 is bypassed to the inlet port 43 of the cylinder 4 through the communication line 150 and the bypass line 160. Consequently, compression is performed only in the inner compression chamber A2 while compression is not performed in the outer compression chamber B2 due to an idling phenomenon such as no-load operation.

As apparent from the above description, the present invention provides a capacity-changing unit disposed in an orbiting vane compressor, which compresses refrigerant gas introduced into a cylinder through an orbiting movement of an orbiting vane in the cylinder, for easily changing capacity of the orbiting vane compressor in a mechanical bypass fashion without interrupting the operation of the orbiting vane compressor, whereby the orbiting vane compressor is selectively operated not only in normal operation mode where compression is performed in both of inner and outer compression chambers but also in economic operation mode where compression is performed only in the inner compression chamber. Consequently, the present invention has the effect of reducing expenses necessary to operate the orbiting vane compressor and preventing excessive power consumption and reduction in service life of various electric circuit control devices and relevant parts due to alternate interruption and resumption of the orbiting vane compressor, and therefore, improving quality and reliability of the orbiting vane compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A capacity-changing unit of an orbiting vane compressor, comprising:

an orbiting vane which compresses refrigerant gas sucked by an orbiting of a circular vane, the circular vane being formed on a vane plate and positioned in an annular space formed between an inner wall of a cylinder and an inner ring of the cylinder so as to divide the annular space into an inner compression chamber and an outer compression chamber, the cylinder comprising inner and outer outlet ports which communicate with the inner and outer compression chambers and an inlet port through which the refrigerant gas is sucked;

a communication line having an end which communicates with the outer compression chamber;

a bypass line which communicates with the communication line and the inlet port;

a pressurizing line connected to the inner and outer outlet ports of the cylinder;

a piston which closes the communication line and the bypass line based on a discharge pressure of refrigerant gas passing through the pressurizing line; and a solenoid which moves the piston and opens the communication line and the bypass line based on an applied power.

2. An orbiting vane compressor, comprising:

a shell having an inlet tube and an outlet tube formed thereon;

a crank shaft which is rotated by a drive unit inside the shell, an orbiting vane having a circular vane formed thereon being mounted on one end of the crank shaft, the circular vane being positioned in an annular space formed between an inner wall of a cylinder and an inner ring of the cylinder so as to divide the annular space into an inner compression chamber and an outer compression chamber, the cylinder comprising inner and outer outlet ports which communicate with the inner and outer compression chambers;

a pressurizing portion comprising an inlet port formed on a side of the cylinder, refrigerant gas introduced through the inlet tube being sucked into the inlet port;

a communication line having an end which communicates with the outer compression chamber of the cylinder;

a bypass line which communicates with the communication line and the inlet port;

a pressurizing line connected to the inner and outer outlet ports of the cylinder;

a piston which closes the communication line and the bypass line based on a discharge pressure of refrigerant gas passing through the pressurizing line; and a solenoid which moves the piston and opens the communication line and the bypass line based on an applied power.

* * * * *